US009072414B2

(12) United States Patent
Riggs

(10) Patent No.: US 9,072,414 B2
(45) Date of Patent: Jul. 7, 2015

(54) STANDUP POUCH WITH DISPENSING FITMENT

(76) Inventor: Jon M. Riggs, Oconomowoc, WI (US)

( * ) Notice: Subject to any disclaimer, the term of this patent is extended or adjusted under 35 U.S.C. 154(b) by 0 days.

(21) Appl. No.: 13/405,724

(22) Filed: Feb. 27, 2012

(65) Prior Publication Data

US 2012/0223178 A1 Sep. 6, 2012

Related U.S. Application Data

(60) Provisional application No. 61/448,004, filed on Mar. 1, 2011.

(51) Int. Cl.

| | |
|---|---|
| ***B65D 69/00*** | (2006.01) |
| ***A61J 9/00*** | (2006.01) |
| ***B65D 45/00*** | (2006.01) |
| ***A47K 10/38*** | (2006.01) |
| ***B65D 75/58*** | (2006.01) |
| ***B65D 83/08*** | (2006.01) |
| *A47K 10/32* | (2006.01) |

(52) U.S. Cl.

CPC ..... *A47K 10/3818* (2013.01); *A47K 2010/3266* (2013.01); *B65D 75/5883* (2013.01); *B65D 83/0805* (2013.01); *B65D 2575/586* (2013.01)

(58) Field of Classification Search

USPC ..... 206/233; 383/104; 222/92, 568; 215/11.3, 274

See application file for complete search history.

(56) References Cited

U.S. PATENT DOCUMENTS

| | | | | |
|---|---|---|---|---|
| 2,520,335 | A * | 8/1950 | Piazze | 215/11.3 |
| 2,604,222 | A * | 7/1952 | Peltz et al. | 215/11.3 |
| 3,847,523 | A * | 11/1974 | Parrish et al. | 425/191 |
| 4,466,547 | A * | 8/1984 | Klittich | 215/11.3 |
| 5,795,071 | A | 8/1998 | Sasaki et al. | |
| 6,981,614 | B2 * | 1/2006 | Niggemyer | 222/107 |
| 7,842,365 | B2 | 11/2010 | Riggs | |
| 7,988,008 | B2 * | 8/2011 | Banik et al. | 220/254.3 |
| 2002/0148846 | A1 * | 10/2002 | Luburic | 220/792 |

* cited by examiner

*Primary Examiner* — Anthony Stashick
*Assistant Examiner* — Kaushikkumar Desai
(74) *Attorney, Agent, or Firm* — Andrus Intellectual Property Law, LLP

(57) ABSTRACT

A dispensing package preferably for containing and dispensing a roll of pre-moistened wipes. The dispensing package includes a standup pouch that defines an open interior for containing the roll of wipes. The standup pouch defines an open top end that receives a dispensing fitment. The dispensing fitment includes a reclosable lid that can be opened and closed to provide access to the open interior of the standup pouch. The dispensing fitment includes an attachment flange used to attach the dispensing fitment to the standup pouch. The attachment flange can be attached to the flexible pouch either through a heat seal or a mechanical attachment. The mechanical attachment can be created through use of a locking ring that entraps the flexible packaging material of the standup pouch between the attachment flange and the locking ring.

12 Claims, 8 Drawing Sheets

STANDUP POUCH WITH DISPENSING FITMENT

CROSS-REFERENCE TO RELATED APPLICATION

The present application is based on and claims priority to U.S. Provisional Patent Application Ser. No. 61/448,004 filed Mar. 1, 2011

BACKGROUND

The present disclosure generally relates to a flexible package including a dispensing fitment. More specifically, the present disclosure relates to a dispensing package that includes a standup flexible pouch that includes the dispensing fitment such that the dispensing package serves as a canister replacement for a roll of wipes on a coreless roll.

Flexible packaging is known to offer significant value and sustainability benefits to product manufacturers, retailers and consumers as compared to solid, molded plastic packaging containers. Flexible packaging provides many consumer conveniences and benefits, including extended shelf life, easy storage, microwavability and refillability. Flexible packaging has proven to require less energy for creation and creates fewer emissions during disposal.

Although flexible packaging has been known as a packaging alternative, flexible packaging has disadvantages in some applications. Thus, molded plastic containers are still useful for a number of packaging applications, including the dispensing of disposable wipes that are formed on a coreless roll.

SUMMARY

The present disclosure relates to a dispensing package including a standup pouch and an attached dispensing fitment such that the combination of the flexible pouch and dispensing fitment can be used as a complete package that serves as a canister replacement, particularly for dispensing wipes contained on a coreless roll. In one embodiment, the dispensing package of the present disclosure includes a hard plastic fitment heat sealed into the open top end of a flexible, standup pouch.

In one embodiment of the disclosure, the fitment is a two-piece structure that includes a hard plastic attachment ring heat sealed to the inside of the flexible, standup pouch. Once the hard plastic attachment ring is heat sealed in place on the pouch, the roll of wipes is positioned within the pouch. Once the roll of material is positioned within the pouch, a dispensing fitment is snap fit into the attachment ring and the end of the roll of towels is thread through the dispensing fitment. In this manner, the user is able to fill the pouch with the material to be dispensed prior to snapping in place the dispensing fitment.

In another embodiment of the present disclosure, the dispensing fitment is a one-piece structure that includes an attachment flange depending from an outer sealing ring. A reclosable lid is movable to engage the outer sealing ring to open and close the dispensing package.

In yet another embodiment of the disclosure, the dispensing fitment includes a locking ring that engages a locking flange formed on the dispensing fitment to entrap the flexible material that forms the standup pouch. The mechanical interaction between the locking ring and the attachment flange holds the fitment in place on the standup pouch.

Other embodiments and features of the present disclosure are contemplated, as will be described in detail below with reference to the drawing Figures.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIGS. 5*a* and 5*b* are section views of another alternate embodiment of the dispensing fitment.

DETAILED DESCRIPTION

Figure 1:
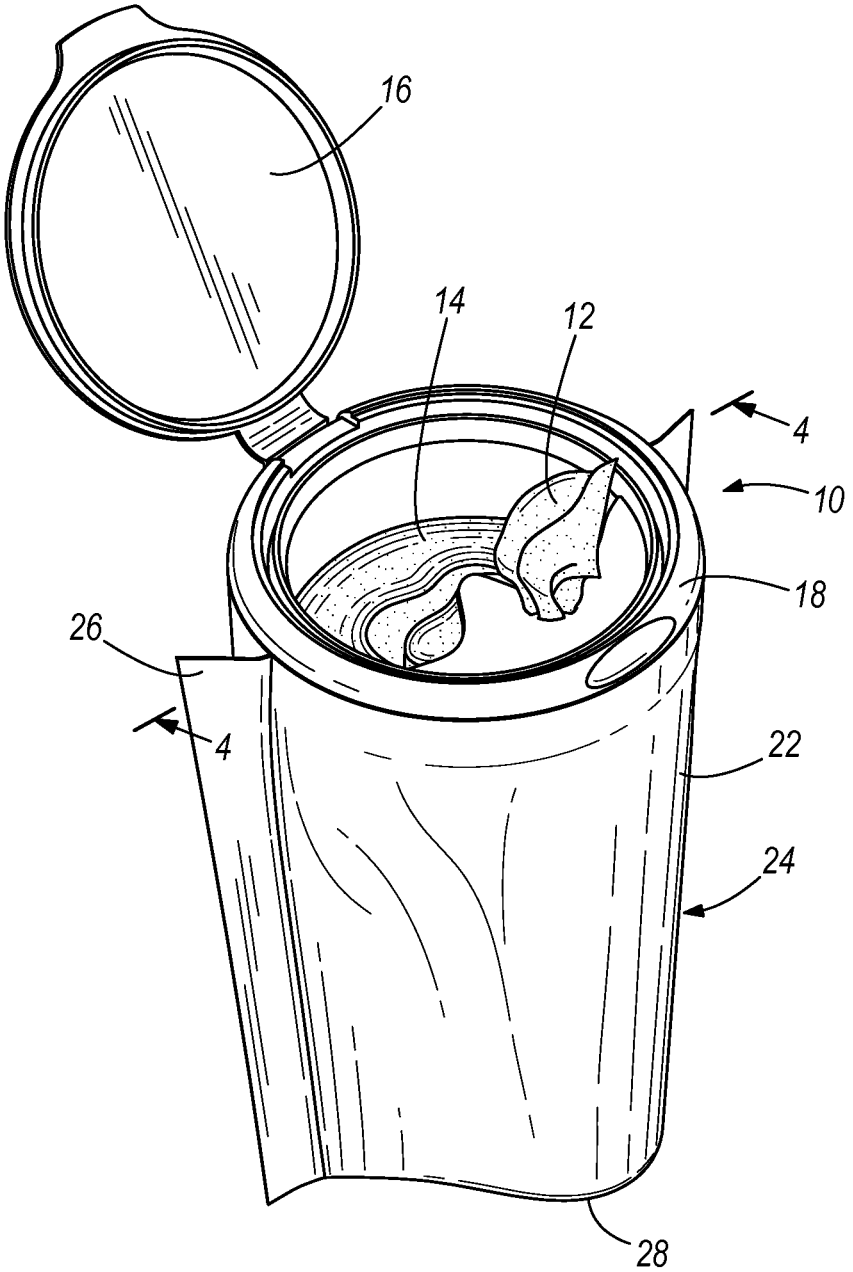
FIG. 1 is a perspective view of a dispensing package constructed in accordance with one embodiment of the disclosure.
Figure 2:
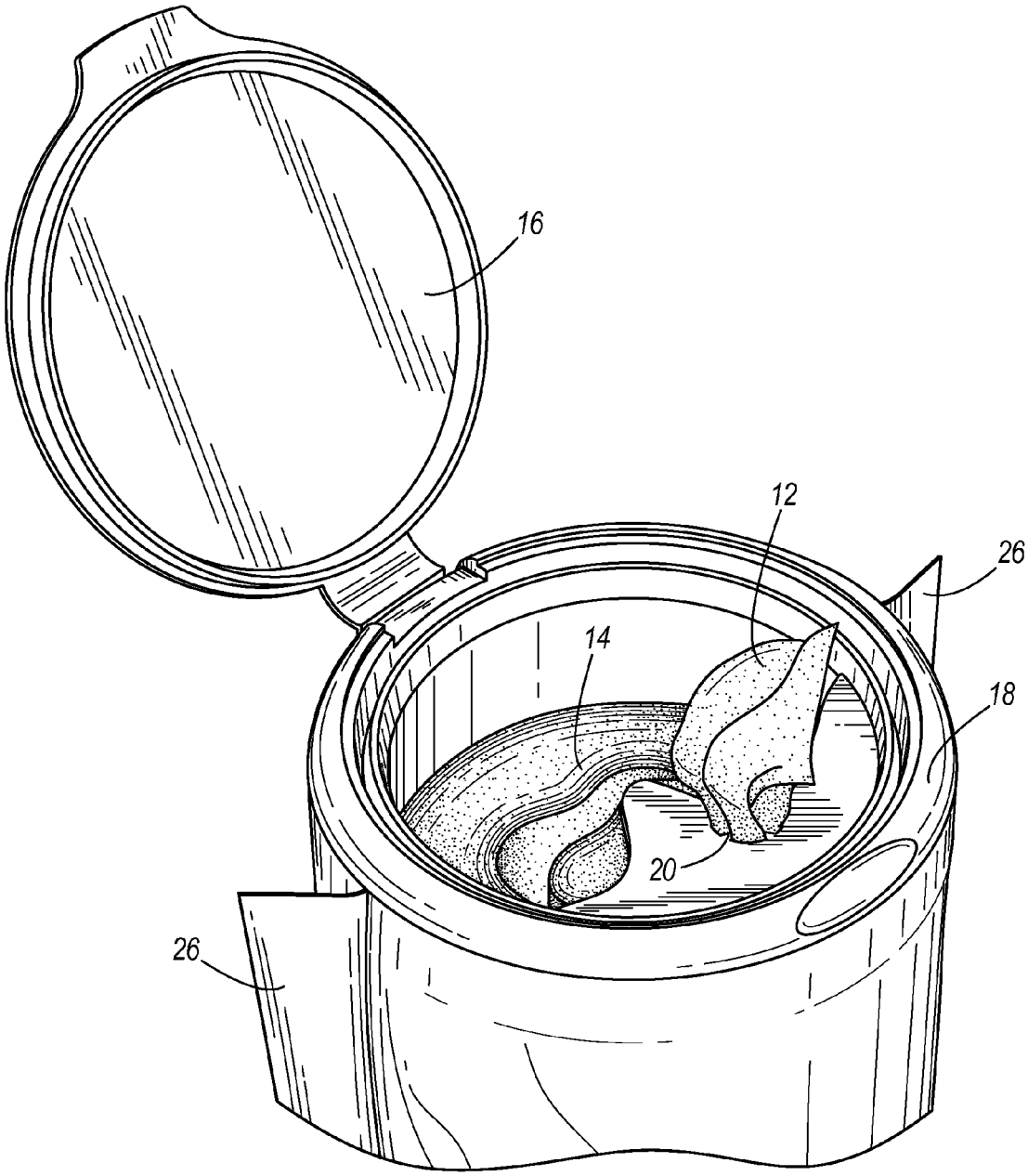
FIG. 2 is a magnified view of the dispensing fitment including the reclosable lid used with the dispensing package of FIG. 1.
Figure 6A:
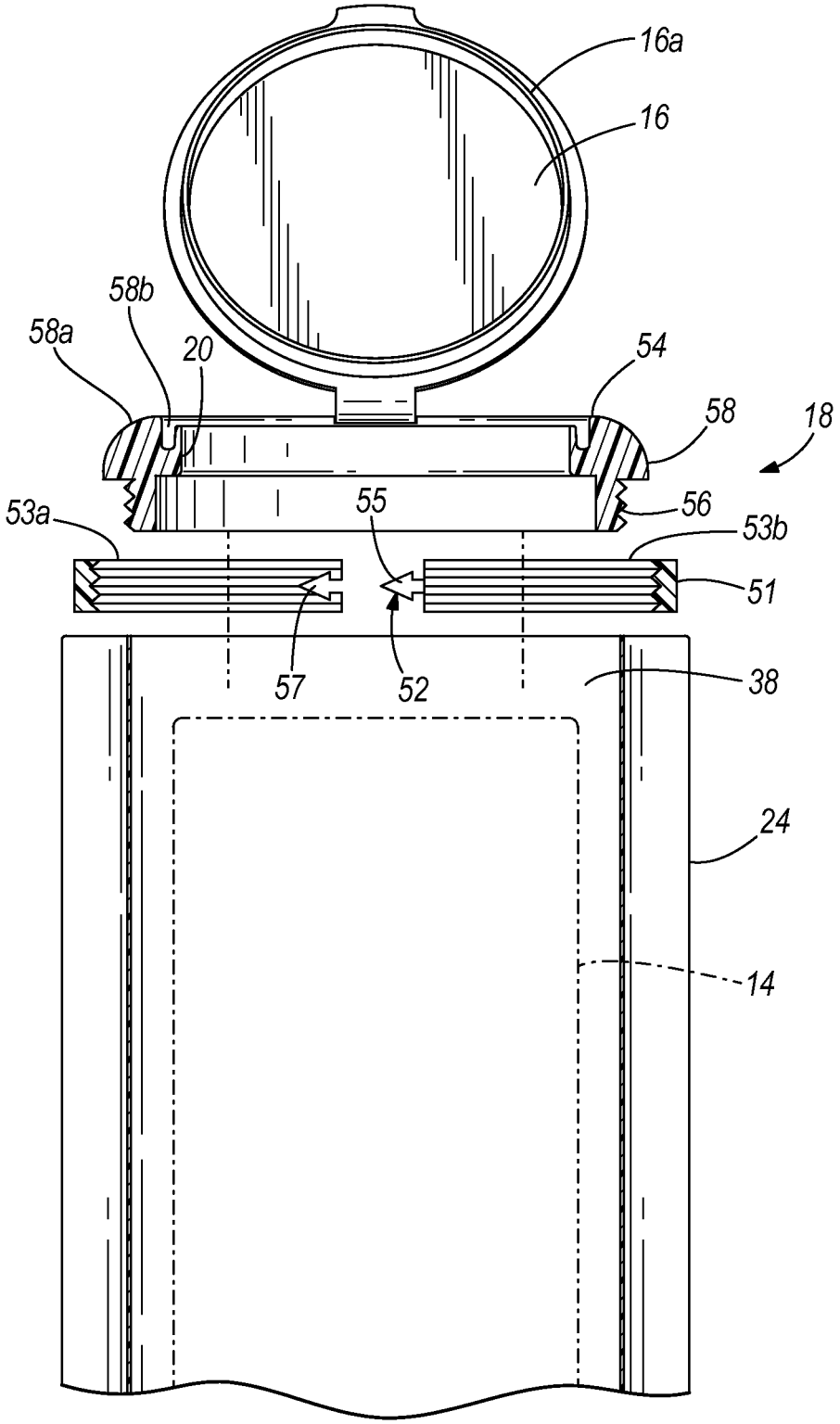
FIG. 6 is another alternate embodiment of the dispensing fitment attached to the flexible, standup pouch.

FIGS. 1 and 2 illustrate a dispensing package 10 for storing and dispensing a product. In the embodiment shown in FIGS. 1 and 2, the dispensing package 10 is particularly useful for dispensing a series of pre-moistened wipes 12 that are contained on a coreless roll 14 as is well known. The wipes 12 are joined to each other along lines of perforation and can be separated and used as desired. The dispensing package 10 includes a reclosable lid 16 that is formed as part of a dispensing fitment 18. The lid 16 includes a first sealing structure preferably in the form of a depending annular lip or protrusion 16*a* such as seen in FIG. 6*a*. In the embodiment shown, the lid 16 creates an air tight seal with the outer sealing ring of the dispensing fitment 18 to prevent the wipes 12 from becoming dried out during storage when the lid 16 is in the closed position (not shown).

As can be seen in FIG. 2, the dispensing fitment 18 includes a dispenser opening 20 that receives the end wipe of the roll of wipes 12. The dispenser opening 20 can be formed in any manner as is well known in the field of pre-moistened wipe dispensing.

In the embodiment shown in FIGS. 1 and 2, the dispensing package 10 includes a package body 22 that surrounds the roll 14 of pre-moistened wipes 12. In the embodiment illustrated, the package body 22 is formed form a flexible packaging film that is formed in the shape of a standup pouch 24 and defined at each edge by one of a pair of side seals 26. The standup pouch 24 includes a bottom 28 that allows the standup pouch 24 to be self-supporting, as shown in FIGS. 1 and 2.

Figure 3:
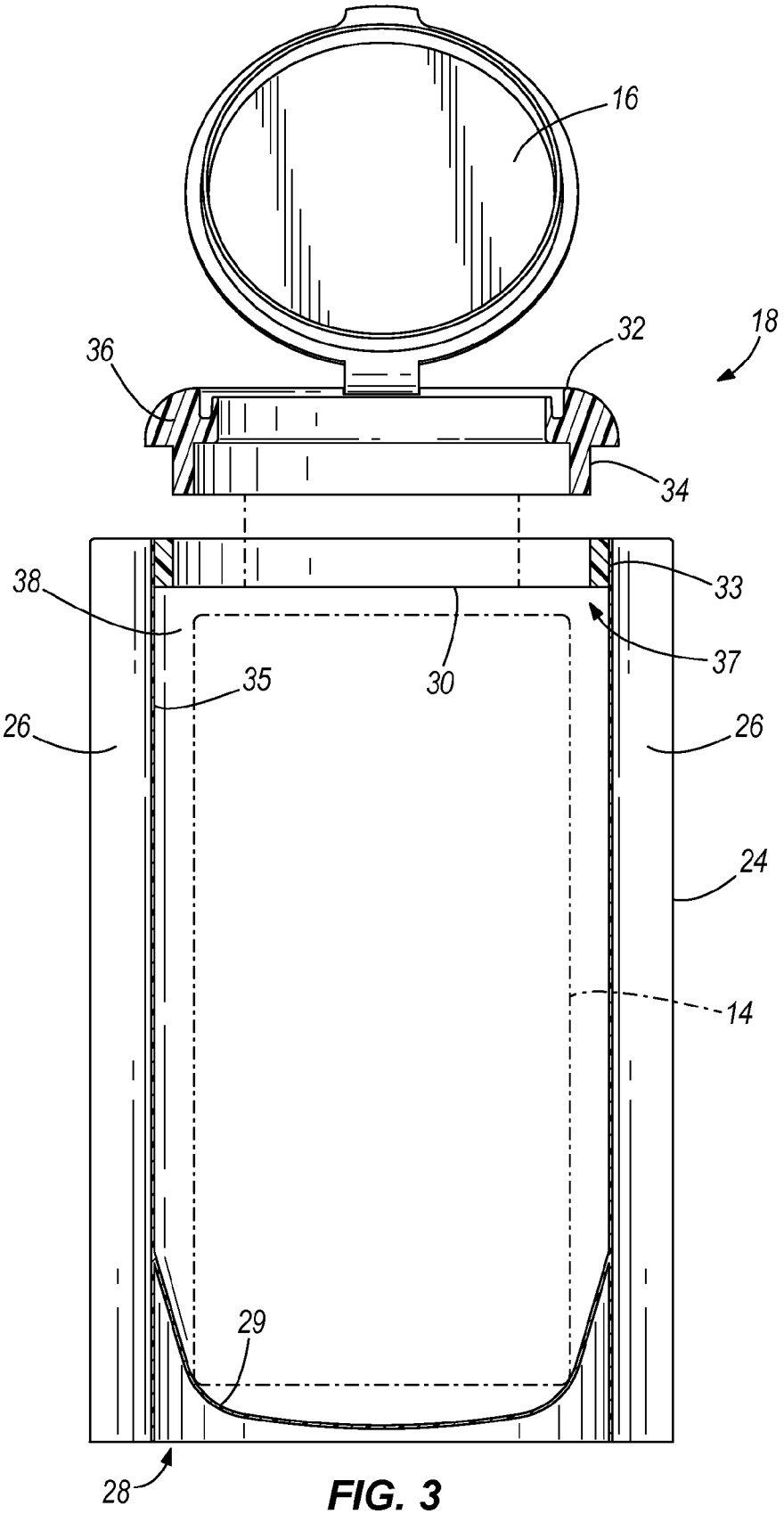
FIG. 3 is an exploded section view of a first embodiment of the dispensing package including the dispensing fitment and reclosable lid.

As illustrated in FIG. 3, the bottom 28 includes an inner, bottom wall 29 that extends between the pair of spaced side seals 26. The configuration of the standup pouch, including the inner bottom wall 29 extending between the pair of spaced side seals 26, is a conventional standup pouch formed from flexible packaging material that has been used in various other applications, such as flexible pouches used to contain juice.

Referring now to FIG. 3, thereshown is a first embodiment of the dispensing fitment 18. In the embodiment shown in FIG. 3, the dispensing fitment 18 is a two-piece member including an attachment ring 30 and a cover member 32. The attachment ring 30 is an annular member having an outer surface 33 heat sealed to the inner surface of the pouch wall 35 of the flexible standup pouch 24 at an open top end 37 that provides access to the open interior 38. The attachment ring 30 receives an attachment flange 34 that is connected to an outer sealing ring 36 that is sized to receive the reclosable lid 16. The cover members 32 can snap into place along the attachment ring 30 once the attachment ring 30 is heat sealed into the position shown in FIG. 3. During assembly, the attachment ring 30 is heat sealed to the flexible standup pouch 24 and the roll of wipes 14 is positioned within the open interior 38. Once the roll of wipes 14 is positioned within the open interior 38, the cover member 32 is snapped into place on the attachment ring 30 to form the dispensing package 10.

In the embodiment shown in FIG. 3, the internal diameter of the attachment ring 30 is selected to form an interference fit with the outer diameter of the attachment flange 34 such that the cover member 32 is held securely in place within the top mouth 37 of the dispensing package. Although an interference fit is designed to provide the required holding force between the cover member 32 and the attachment ring 30, additional mechanical attachment methods, such as sonic welding or an adhesive, are contemplated as being useful to hold the cover member 32 in its position with respect to the attachment ring 30.

Figure 4:
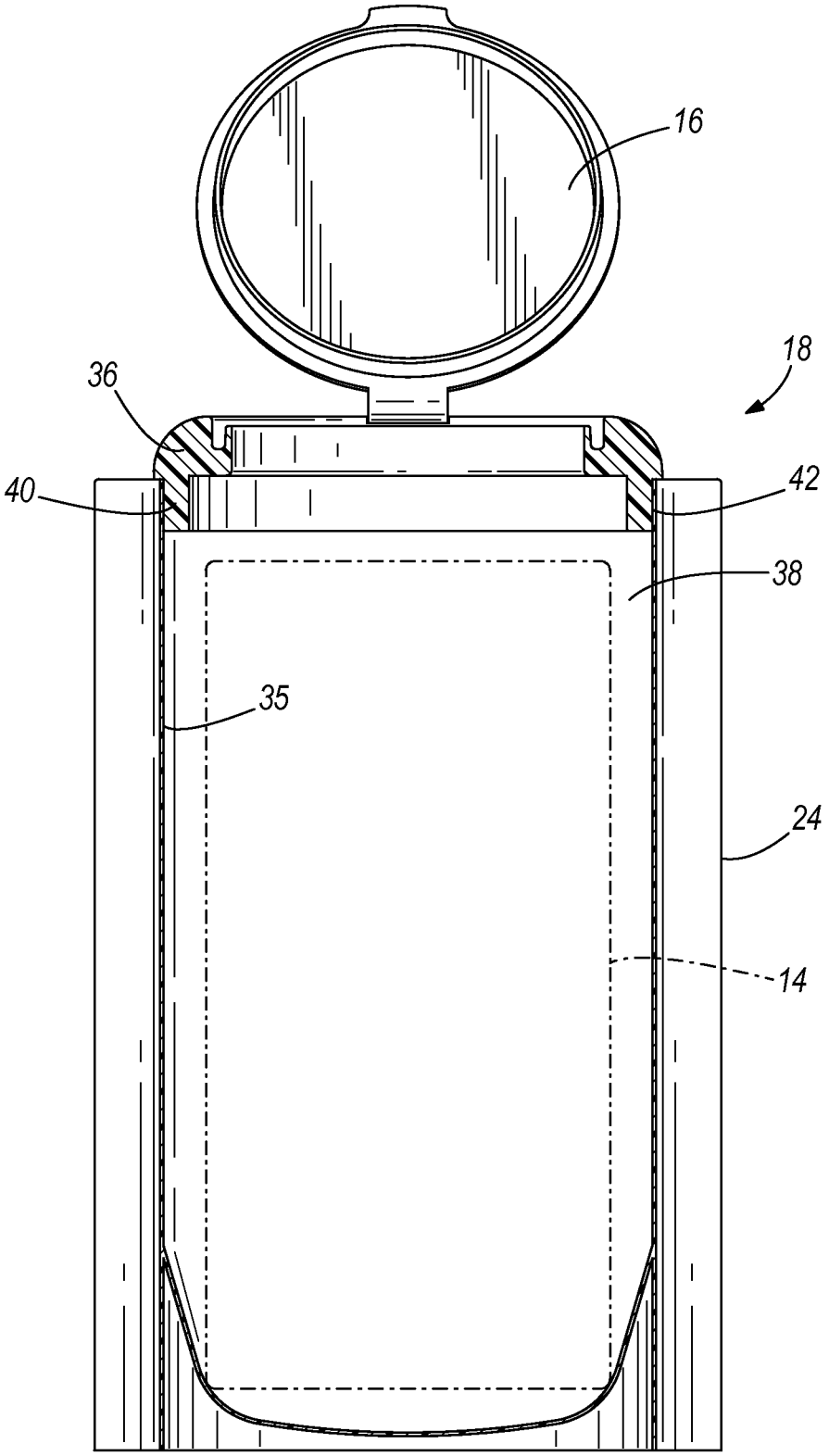
FIG. 4 is a second embodiment of the dispensing fitment attached to the flexible, standup pouch.

Referring now to FIG. 4, thereshown is a second embodiment of the dispensing fitment 18 attached to the standup pouch 24. In the second embodiment shown in FIG. 4, the entire dispensing fitment 18 is formed as a one-piece member in which an attachment flange 40 defines an outer sealing surface 42. The outer sealing surface 42 is heat sealed to the wall 35 of the standup pouch 24. Once the outer sealing surface 42 is heat sealed to the standup pouch 24, the roll of material 14 can be inserted into the open interior 38. The reclosable lid 16 is received by a similar sealing ring 36.

Figure 5A:
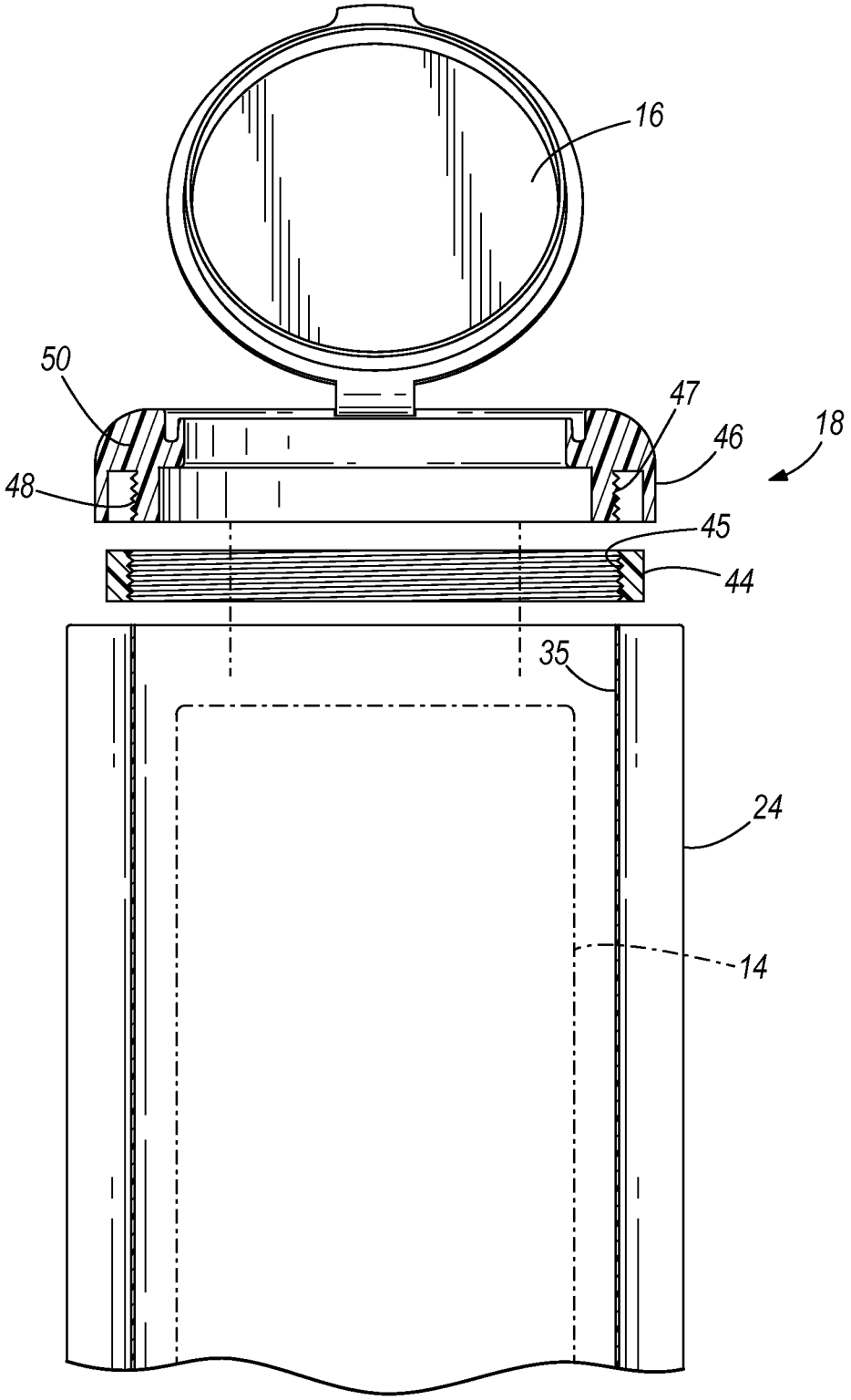
FIG. 5*a* is a third embodiment of the dispensing fitment attached to the flexible, standup pouch.
Figure 5B:
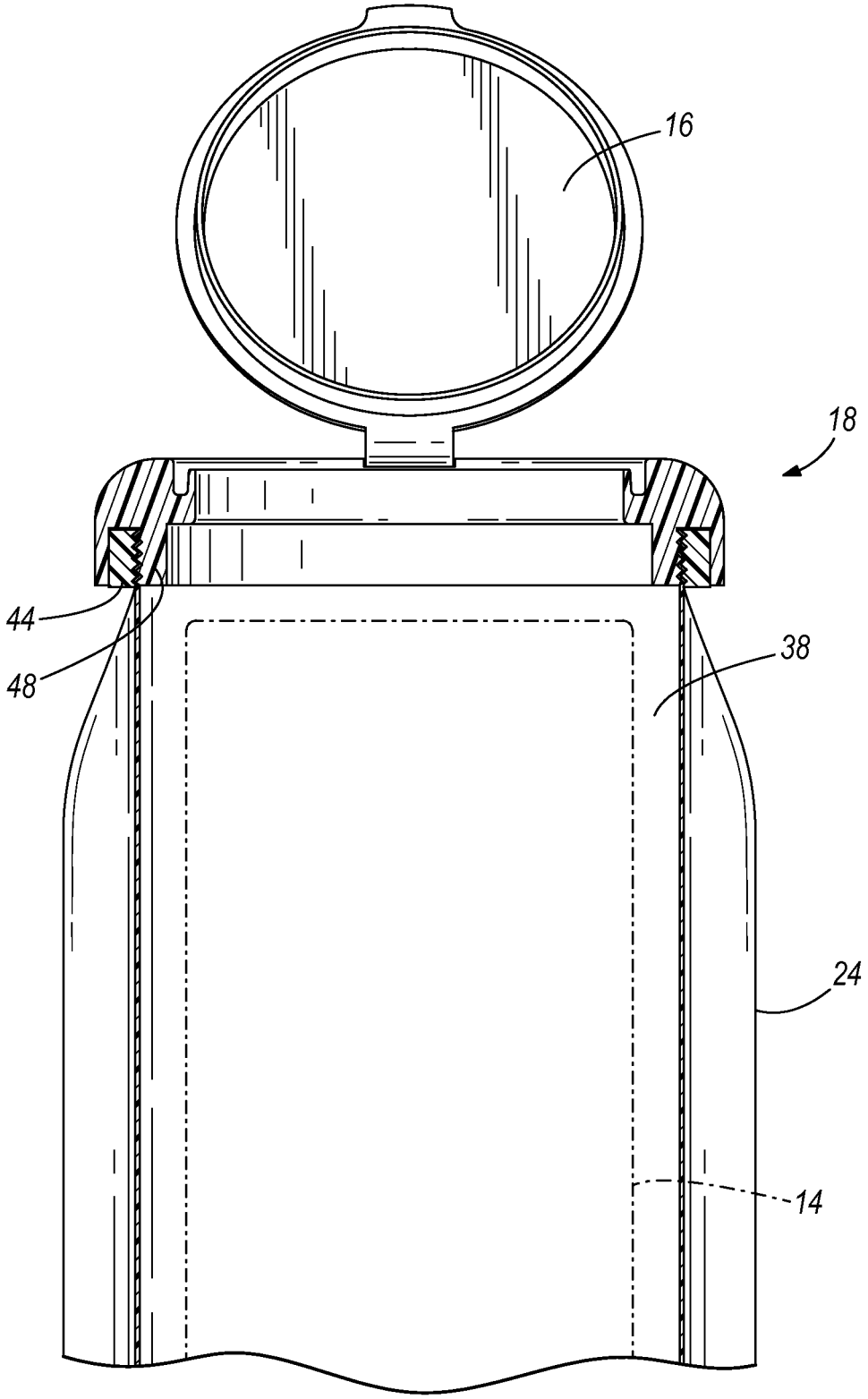

FIG. 5*a* illustrates a third embodiment of the dispensing fitment 18. In this embodiment, the dispensing fitment 18 includes a locking ring 44 and a cover member 46. The cover member 46 includes an attachment flange 48 that extends below a sealing ring 50. As can be understood in FIG. 5*b*, the attachment flange 48 is positioned within the open interior 38 of the standup pouch 24. The locking ring 44 is positioned along the exterior surface of the standup pouch and includes a series of threads 45 that engage corresponding threads 47 on the attachment flange 48. Rotation of the locking ring 44 entraps the wall 35 between the locking ring 44 and the attachment flange 48. In this manner, no heat sealing is required and a mechanical attachment is created by the threaded interaction between the locking ring 44 and the attachment flange 48.

Figure 6B:
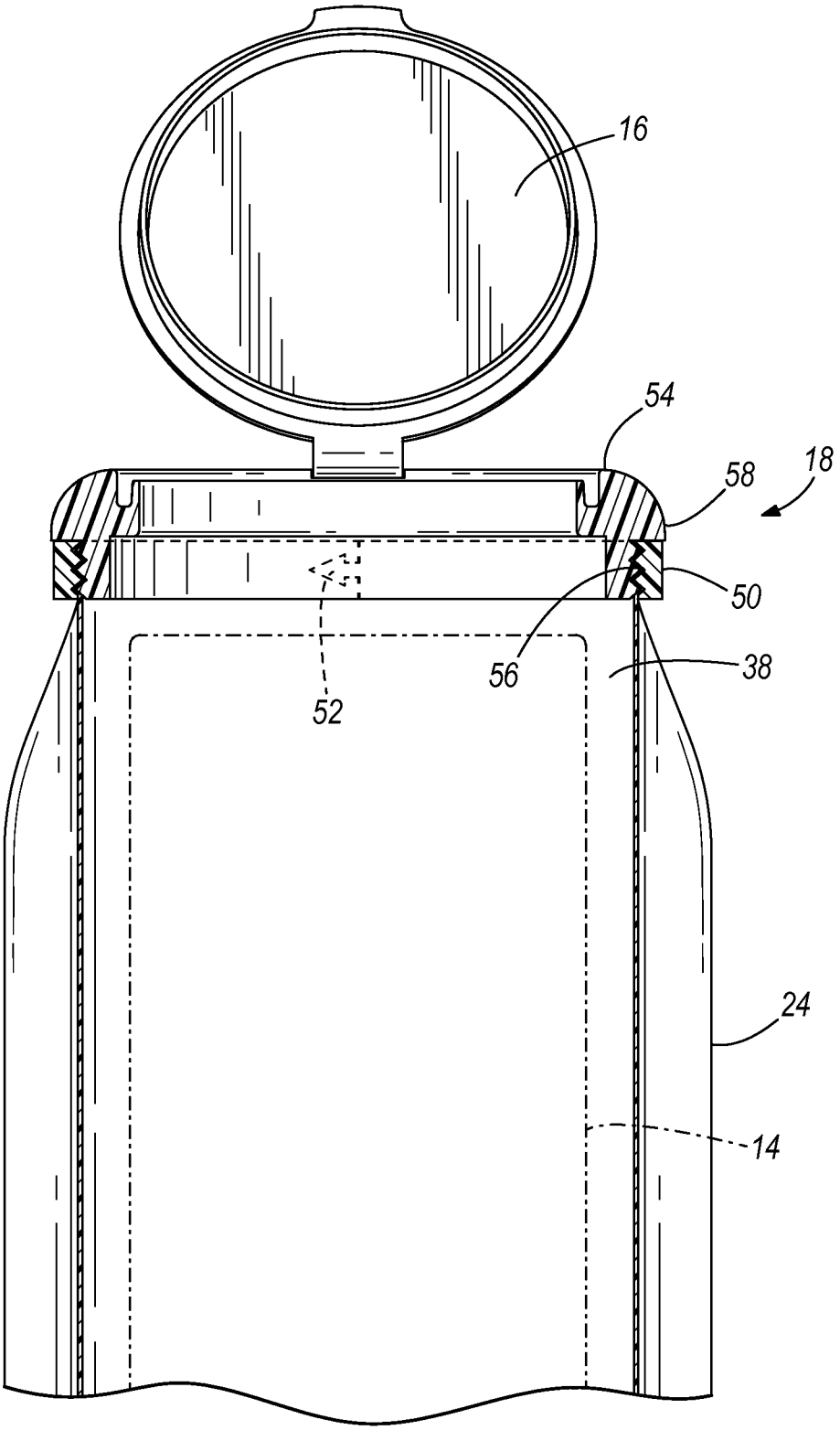

Referring now to FIGS. 6*a* and 6*b*, thereshown is yet another alternate embodiment. In this embodiment, the dispensing fitment 18 includes a two-piece locking ring 51 having a first member 53*a* and a second member 53*b*. A locking mechanism 52 operates to join the two separate pieces 53*a*, 53*b* of the locking ring 51. In the embodiment shown in FIG. 4, the locking mechanism 52 includes a male protrusion 55 that is received within a corresponding female receptacle 57. Although one embodiment of the locking mechanism 52 is shown in FIG. 6*a*, it should be understood that various other types of locking mechanisms 52 could be utilized while operating within the scope of the present disclosure.

The cover member 54 includes an attachment flange 56 that extends below and is permanently formed with the outer sealing ring 58. The outer sealing ring 58 has an uppermost planar sealing surface 58*a* formed therethrough with the dispenser opening 20 in communication with the open interior 38. The sealing surface 58*a* is also formed with a second sealing structure in the preferred form of an annular groove 58*b* which extends around and lies adjacent the dispenser opening 20. The groove 58*b* is designed to selectively receive and retain in a frictional sealing fit the annular lip or protrusion 16*a* on lid 16 which is secured to the sealing surface 58*a*. The attachment flange 56 includes a series of serrations that match a similar series of serrations along the inner wall of the locking ring 51. The dispensing fitment 18 is attached to the standup pouch 24 by first positioning the attachment flange 56 within the open interior 38. Once positioned, the locking ring 51 is secured to the attachment flange 56 to create the fluid tight seal between the cover member 54 and the pouch 24. As with the embodiment shown in FIGS. 5*a*-5*b*, the embodiment of FIGS. 6*a* and 6*b* does not require any heat sealing and the dispensing fitment 18 is positioned on the pouch after the roll 14 of product is inserted.

In the embodiments shown in the drawing Figures, the outer surface of the dispensing fitment that forms a heat seal with the standup pouch is circular. However, it is contemplated by the inventor that the outer sealing surface of the dispensing fitment could have tapered sides to ensure a hermetic seal with the standup pouch at each side. In such an embodiment, the lid would still engage a circular sealing ring as in the embodiments illustrated. It should be understood that in each of the embodiments disclosed herein, the outer sealing ring includes an uppermost sealing surface and a reclosable lid having similar structure and sealing engagement as described relative to FIGS. 6*a* and 6*b*.

Although the present disclosure is shown and described as being a replacement for a canister including wet wipes wound on a cordless roll, the present disclosure could be utilized in various other applications. As an example, the standup pouch with the dispensing fitment of the present disclosure could replace jars that include twist-off caps and other types of dispensers within the cap. In such embodiments, the dispensing fitment would be heat sealed to the flexible packaging material that forms the standup pouch and the dispensing fitment would allow for sealing and resealing of the product package. Thus, the present disclosure is primarily directed to a dispensing fitting that can be heat sealed or mechanically attached to a flexible, standup pouch such that the package can be resealed.

I claim:

1. A dispensing package, comprising:

a standup pouch that defines an open interior, a closed bottom end and an open top end; and a dispensing fitment attached to the standup pouch at the open top end, the dispensing fitment including a locking ring and a cover member having a reclosable lid provided with a first sealing structure and configured to selectively provide access to the open interior through the dispensing fitment;

wherein the cover member includes an outer sealing ring permanently formed with an attachment flange depending therefrom, the outer sealing ring having an uppermost sealing surface formed therethrough with a dispenser opening in communication with the open interior, and a second sealing structure located adjacent the dispenser opening for selectively receiving and retaining the first sealing structure of the reclosable lid to provide a sealed frictional engagement between the reclosable lid and the outer sealing ring; and wherein the reclosable lid is secured to the uppermost sealing surface of the outer sealing ring, and the attachment flange is attached to material forming the standup pouch and receives the locking ring to secure the material between the attachment flange and the locking ring.

2. The dispensing package of claim 1 wherein the standup pouch is formed from a flexible material.

3. The dispensing package of claim 1 wherein the locking ring is formed from a first member and a second member that are selectively joined to each other to surround the attachment flange.

4. The dispensing package of claim 1 wherein the locking ring includes a series of threads that engage a corresponding series of threads formed on the attachment flange.

5. A dispensing fitment for use with a standup pouch that defines an open interior, a closed bottom end and an open top end, comprising:

an outer sealing ring having an uppermost sealing surface formed therethrough with a dispenser opening in communication with the open interior, and an annular groove recessed from the uppermost sealing surface, the annular groove located adjacent the dispenser opening;

a reclosable lid provided with an annular protrusion that engages the annular groove on the outer sealing ring in a frictional sealed fit, the lid being attached to the uppermost sealing surface;

an attachment flange permanently formed with and depending from the outer sealing ring, the attachment flange being configured to be attached to the open top end of the standup pouch; and a locking ring, wherein the locking ring attaches the standup pouch to the attachment flange of the dispensing fitment.

6. A dispensing fitment for use with a standup pouch that defines an open interior, a closed bottom end and an open top end, comprising:

an outer sealing ring having an uppermost sealing surface formed therethrough with a dispenser opening in communication with the open interior, and an annular groove recessed from the uppermost sealing surface, the annular groove located adjacent the dispenser opening;

a reclosable lid provided with an annular protrusion that engages the annular groove on the outer sealing ring in a frictional sealed fit, the lid being attached to the uppermost sealing surface; and an attachment flange permanently formed with and depending from the outer sealing ring, the attachment flange being configured to be attached to the open top end of the standup pouch; and an attachment ring attached to the standup pouch, wherein the attachment flange is received by the attachment ring to secure the dispensing fitment to the standup pouch.

7. The dispensing package of claim 5 wherein the locking ring is formed from a first member and a second member that are selectively joined to each other to surround the attachment flange.

8. The dispensing package of claim 5 wherein the locking ring includes a series of threads that engage a corresponding series of threads formed on the attachment flange.

9. A dispensing package for a series of pre-moistened wipes, comprising:

a standup pouch formed from a flexible material, the standup pouch defining an open interior, a closed bottom end and an open top end; and a dispensing fitment attached to the standup pouch at the open top end, the dispensing fitment including an outer sealing ring, a reclosable lid and an attachment flange, wherein the resealable lid engages the outer sealing ring and the attachment flange is attached to the standup pouch;

a locking ring, wherein the locking ring attaches the flexible material of the standup pouch to the attachment flange of the dispensing fitment wherein the outer sealing ring has a planar uppermost sealing surface formed therethrough with a dispenser opening in communication with the open interior, and an annular groove located adjacent and surrounding the dispenser opening;

wherein the reclosable lid is provided with an annular protrusion that is selectively received and retained in a sealing frictional fit in the groove, the reclosable lid being secured to the uppermost sealing surface; and wherein the attachment flange is permanently formed with and depends from the outer sealing ring.

10. A dispensing package for a series of pre-moistened wipes, comprising:

a standup pouch formed from a flexible material, the standup pouch defining an open interior, a closed bottom end and an open top end; and a dispensing fitment attached to the standup pouch at the open top end, the dispensing fitment including an outer sealing ring, a reclosable lid and an attachment flange, wherein the resealable lid engages the outer sealing ring and the attachment flange is attached to the standup pouch;

an attachment ring attached to the standup pouch, wherein the attachment flange is received by the attachment ring to secure the dispensing fitment to the standup pouch;

wherein the outer sealing ring has a planar uppermost sealing surface formed therethrough with a dispenser opening in communication with the open interior, and an annular groove located adjacent and surrounding the dispenser opening;

wherein the reclosable lid is provided with an annular protrusion that is selectively received and retained in a sealing frictional fit in the groove, the reclosable lid being secured to the uppermost sealing surface; and wherein the attachment flange is permanently formed with and depends from the outer sealing ring.

11. The dispensing package of claim 9 wherein the locking ring is formed from a first member and a second member that are selectively joined to each other to surround the attachment flange.

12. The dispensing package of claim 9 wherein the locking ring includes a series of threads that engage a corresponding series of threads formed on the attachment flange.

* * * * *